US010923276B2

(12) United States Patent
Lee et al.

(10) Patent No.: US 10,923,276 B2
(45) Date of Patent: Feb. 16, 2021

(54) COIL ELECTRONIC COMPONENT

(71) Applicant: SAMSUNG ELECTRO-MECHANICS CO., LTD., Suwon-si (KR)

(72) Inventors: Young Il Lee, Suwon-si (KR); Han Wool Ryu, Suwon-si (KR); Sang Kyun Kwon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 206 days.

(21) Appl. No.: 15/970,138

(22) Filed: May 3, 2018

(65) Prior Publication Data

US 2019/0164689 A1 May 30, 2019

(30) Foreign Application Priority Data

Nov. 29, 2017 (KR) ..... 10-2017-0161928

(51) Int. Cl.

| | |
|---|---|
| ***H01F 41/12*** | (2006.01) |
| ***H01F 17/00*** | (2006.01) |
| ***H01F 27/32*** | (2006.01) |
| ***H01F 17/04*** | (2006.01) |
| ***H01F 27/24*** | (2006.01) |

(Continued)

(52) U.S. Cl.

CPC ..... *H01F 41/12* (2013.01); *H01F 17/0013* (2013.01); *H01F 17/04* (2013.01); *H01F 27/24* (2013.01); *H01F 27/32* (2013.01); *H01F 27/324* (2013.01); *H01F 41/046* (2013.01); *H01F 41/125* (2013.01); *H01F 1/26* (2013.01); *H01F 2017/048* (2013.01)

(58) Field of Classification Search

CPC .... H01F 17/0013; H01F 27/324; H01F 27/32; H01F 41/12

See application file for complete search history.

(56) References Cited

U.S. PATENT DOCUMENTS

| | | | |
|---|---|---|---|
| 6,181,232 | B1 | 1/2001 | Kitamura |
| 9,773,611 | B2 | 9/2017 | Kim et al. |

(Continued)

FOREIGN PATENT DOCUMENTS

| | | | |
|---|---|---|---|
| CN | 1207565 | A | 2/1999 |
| CN | 104575937 | A | 4/2015 |

(Continued)

OTHER PUBLICATIONS

Korean Office Action dated Feb. 1, 2019 issued in Korean Patent Application No. 10-2017-0161928 (with English translation).

(Continued)

*Primary Examiner* — Elvin G Enad
*Assistant Examiner* — Malcolm Barnes
(74) *Attorney, Agent, or Firm* — Morgan, Lewis & Bockius LLP

(57) ABSTRACT

A coil electronic component includes a body having a coil portion embedded therein and having a form in which magnetic particles are dispersed in a first insulating material, a first atomic layer deposition (ALD) layer formed along a surface of the coil portion using a second insulating material, a second ALD layer formed along a surface of the first ALD layer using a third insulating material, and external electrodes connected to the coil portion.

14 Claims, 4 Drawing Sheets

(51) Int. Cl.
*H01F 41/04* (2006.01)
*H01F 1/26* (2006.01)

(56) References Cited

U.S. PATENT DOCUMENTS

2010/0328007 A1* 12/2010 Witzani ..... H01F 27/263 336/178
2014/0167897 A1* 6/2014 Choi ..... H01F 41/0246 336/83
2014/0247101 A1* 9/2014 Cha ..... H01F 41/12 336/198
2014/0292469 A1* 10/2014 Cha ..... H01F 17/0013 336/200
2015/0028983 A1* 1/2015 Ryu ..... H01F 27/292 336/192
2015/0048915 A1* 2/2015 Yoon ..... H01F 17/0013 336/192
2015/0109088 A1* 4/2015 Kim ..... H01F 17/0013 336/200
2015/0123757 A1* 5/2015 Choi ..... H01F 27/292 336/192
2015/0155093 A1* 6/2015 Kim ..... H01F 27/292 336/192
2015/0255206 A1* 9/2015 Han ..... H01F 17/0013 336/192
2015/0302987 A1* 10/2015 Sano ..... H01F 41/04 29/602.1
2015/0371781 A1* 12/2015 Choi ..... H01G 4/30 361/767
2016/0086716 A1* 3/2016 Choi ..... H01F 27/292 336/221
2016/0126004 A1* 5/2016 Yang ..... H01F 27/292 336/90
2016/0172096 A1* 6/2016 Jeong ..... H01F 27/292 336/200
2016/0172102 A1* 6/2016 Jeong ..... H01F 17/0013 336/192
2016/0217909 A1* 7/2016 Park ..... H01F 27/292
2016/0225513 A1* 8/2016 Park ..... H01F 17/0013
2016/0247624 A1* 8/2016 Seo ..... H01F 27/324
2016/0293320 A1* 10/2016 Kim ..... H01F 17/0013
2016/0314889 A1* 10/2016 Ryu ..... H01F 41/0246
2017/0117082 A1 4/2017 Jeong

FOREIGN PATENT DOCUMENTS

CN 104756208 A 7/2015
JP 2006-253320 A 9/2006
KR 10-2004-0097676 A 11/2004
KR 10-2015-0046717 A 4/2015
KR 10-2015-0068940 A 6/2015
KR 10-1565703 B1 11/2015
KR 10-2017-0048724 A 5/2017

OTHER PUBLICATIONS

Office Action issued in corresponding Chinese Patent Application No. 201811080964.6 dated Jun. 23, 2020, with English translation.

* cited by examiner

COIL ELECTRONIC COMPONENT

CROSS-REFERENCE TO RELATED APPLICATION

This application claims the benefit of priority to Korean Patent Application No. 10-2017-0161928 filed on Nov. 29, 2017 in the Korean Intellectual Property Office, the disclosure of which is incorporated herein by reference in its entirety.

BACKGROUND

1. Field

The present disclosure relates to a coil electronic component.

2. Description of Related Art

In accordance with miniaturization and thinning of electronic devices such as a digital television (TV), a mobile phone, a laptop computer, and the like, miniaturization and thinning of coil electronic components used in such electronic devices have been demanded. In order to satisfy such demand, research and development of various winding type or thin film type coil electronic components have been actively conducted.

A main issue depending on the miniaturization and thinning of the coil electronic component is to implement characteristics equal to characteristics of an existing coil electronic component in spite of the miniaturization and thinning. In order to satisfy such demand, a ratio of a magnetic material should be increased in a core in which the magnetic material is filled. However, there is a limitation in increasing the ratio due to a change in mechanical strength of a body of an inductor, frequency characteristics depending on insulation properties of the body, and the like.

As an example of a method of manufacturing the coil electronic component, a method of implementing the body by stacking and then pressing sheets in which magnetic particles, a resin, and the like, are mixed with each other on coils has been used, and ferrite, a metal, or the like, may be used as the magnetic particles. When metal magnetic particles are used, it is advantageous in terms of characteristics such as a magnetic permeability, or the like, of the coil electronic component to increase a content of the metal magnetic particles. However, in this case, insulation properties of the body are deteriorated, such that breakdown voltage characteristics of the coil electronic component may be deteriorated.

SUMMARY

An aspect of the present disclosure may provide a coil electronic component of which electrical and magnetic characteristics may be improved by improving an electrical insulation property between a body and coil patterns.

According to an aspect of the present disclosure, a coil electronic component may include a body which includes magnetic particles dispersed in a first insulating material, and a coil portion embedded in the first insulating material. The coil electronic component may also include a first atomic layer deposition (ALD) layer along a surface of the coil portion and formed of a second insulating material; a second ALD layer along a surface of the first ALD layer and formed of a third insulating material; and external electrodes connected to the coil portion.

The first ALD layer may have a thickness of 0.5 μm or less.

The second ALD layer may have a thickness of 0.5 μm or less.

The first and second ALD layers may be formed of the same material.

The first and second ALD layers may be formed of different materials.

A material of the coil portion may have a coefficient of thermal expansion (CTE) greater than that of a material of the first ALD layer, and the material of the first ALD layer may have a CTE greater than that of a material of the second ALD layer.

The first ALD layer may include aluminum oxide or alumina $Al_2O_3$, and the second ALD layer may include silicon oxide or silica $SiO_2$.

The coil portion may include copper Cu.

The magnetic particles may be filled between adjacent coil patterns in the coil portion.

Only the first ALD layer may be formed between adjacent coil patterns in the coil portion.

The magnetic particle may have conductivity.

The magnetic particle may include an Fe-based alloy.

The first insulating material may be an insulating resin.

A method of forming a coil electronic component comprising forming a body by forming a coil portion; conformally forming a physical vapor deposition (PVD) layer by PVD except atomic layer deposition (ALD), along a surface of the coil portion and formed of a first insulating material; forming magnetic particles dispersed in a second insulating material; and embedding the coil portion in the second insulating material. The method may also include forming external electrodes connected to the coil portion.

In the method, the magnetic particles may fill in a gap between adjacent coil patterns in the coil portion, according to some embodiments of the present disclosure.

In the method, only the PVD layer may fill in a gap between adjacent coil patterns in the coil portion, according to some embodiments of the present disclosure.

In the method, the first insulating material and the second insulating material may be the same, according to some embodiments of the present disclosure.

In the method, the first insulating material and the second insulating material may be different, according to some embodiments of the present disclosure.

In the method, a second PVD layer may be formed on the PVD layer, according to some embodiments of the present disclosure.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Electronic Device

Figure 1:
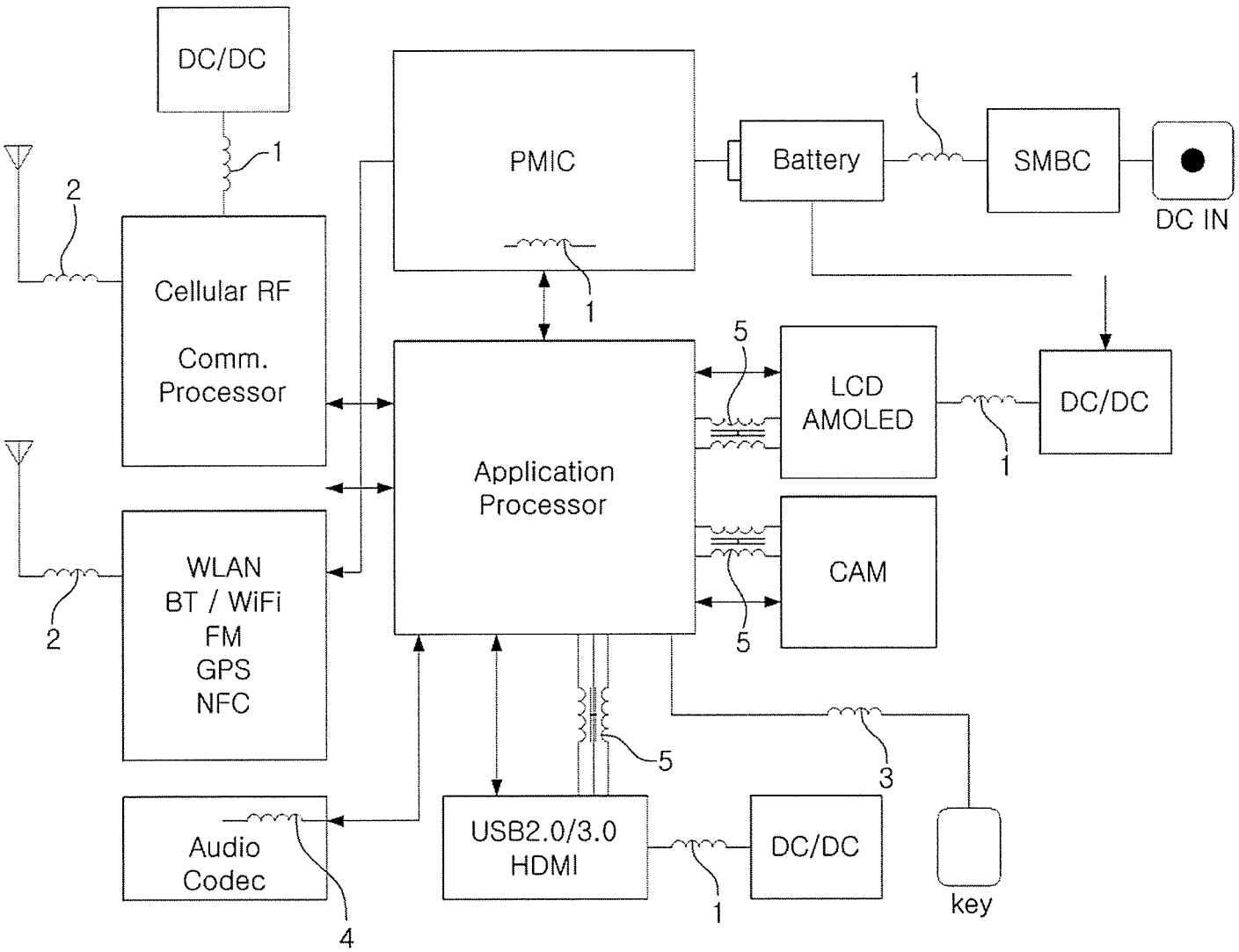
FIG. 1 is a schematic view illustrating an embodiment of a coil electronic component used in an electronic device.

FIG. 1 is a schematic view illustrating an embodiment of a coil electronic component used in an electronic device.

Referring to FIG. 1, it may be appreciated that various kinds of electronic components are used in an electronic device. For example, an application processor, a direct current (DC) to DC converter, a communications processor, a wireless local area network Bluetooth (WLAN BT)/wireless fidelity frequency modulation global positioning system near field communications (WiFi FM GPS NFC), a power management integrated circuit (PMIC), a battery, a SMBC, a liquid crystal display active matrix organic light emitting diode (LCD AMOLED), an audio codec, a universal serial bus (USB) 2.0/3.0 a high definition multimedia interface (HDMI), a CAM, and the like, may be used. In this case, various kinds of coil electronic components may be appropriately used between these electronic components depending on their purposes in order to remove noise, or the like. For example, a power inductor 1, high frequency (HF) inductors 2, a general bead 3, a bead 4 for a high frequency (e.g. GHz), common mode filters 5, and the like, may be used.

In detail, the power inductor 1 may be used to store electricity in a magnetic field form to maintain an output voltage, thereby stabilizing power. In addition, the high frequency (HF) inductor 2 may be used to perform impedance matching to secure a required frequency or cut off noise and an alternating current (AC) component. Further, the general bead 3 may be used to remove noise of power and signal lines or remove a high frequency ripple. Further, the bead 4 for a high frequency (GHz) may be used to remove high frequency noise of a signal line and a power line related to an audio. Further, the common mode filter 5 may be used to pass a current therethrough in a differential mode and remove only common mode noise.

An electronic device may be typically a smartphone, but is not limited thereto. The electronic device may also be, for example, a personal digital assistant, a digital video camera, a digital still camera, a network system, a computer, a monitor, a television, a video game, a smartwatch, or the like. The electronic device may also be various other electronic devices well-known in those skilled in the art, in addition to the devices described above.

Coil Electronic Component

Hereinafter, a coil electronic component according to the present disclosure, particularly, an inductor will be described for convenience of explanation. However, the coil electronic component according to the present disclosure may also be used as the coil electronic components for various purposes as described above.

Figure 2:
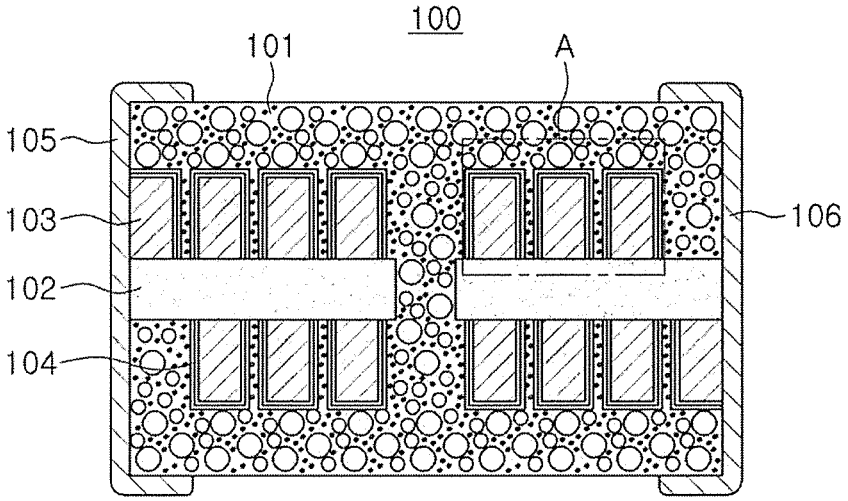
FIG. 2 is a schematic cross-sectional view illustrating a coil electronic component according to an exemplary embodiment in the present disclosure.
Figure 3A:
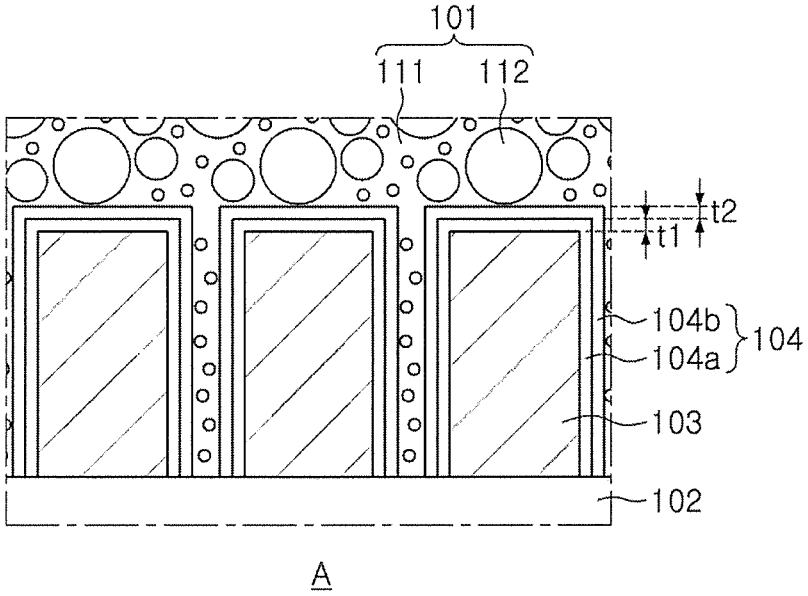
FIG. 3A is an enlarged view of region A of FIG. 2 according to an embodiment of the present disclosure.
Figure 3B:
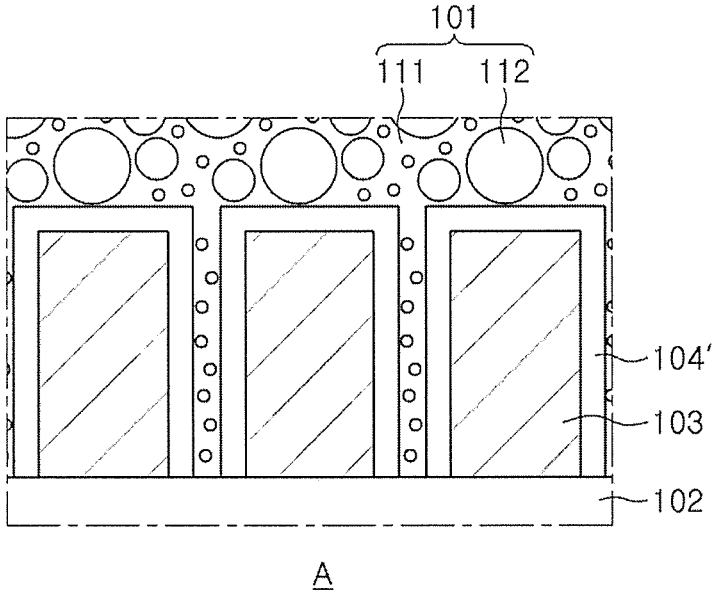
FIG. 3B is an enlarged view of region A of FIG. 2 according to another embodiment of the present disclosure.
Figure 4:
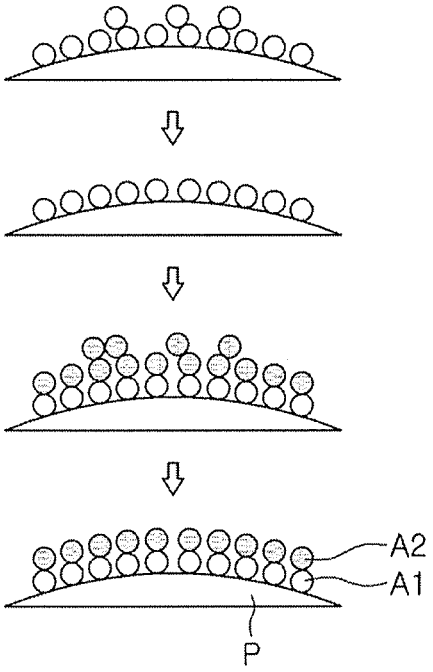
FIG. 4 is a view illustrating a principle that a thin film is formed by atomic layer deposition (ALD)

FIG. 2 is a schematic cross-sectional view illustrating a coil electronic component according to an exemplary embodiment in the present disclosure. FIGS. 3A and 3B are enlarged views of region A of FIG. 2. FIG. 4 is a view illustrating a principle that a thin film is formed by atomic layer deposition (ALD).

A coil electronic component 100 according to an exemplary embodiment in the present disclosure may include a body 101, a coil portion 103, an ALD layer 104, and external electrodes 105 and 106. The coil portion 103 may be embedded in the body 101. In this case, a support member 102 supporting the coil portion 103 may be disposed in the body 101.

The coil portion 103 may perform various functions in the electronic device through characteristics appearing from a coil of the coil electronic component 100. For example, the coil electronic component 100 may be a power inductor. In this case, the coil portion 103 may serve to store electricity in a magnetic field form to maintain an output voltage, resulting in stabilization of power. In this case, coil patterns constituting the coil portion 103 may be stacked on opposite surfaces of the support member 102, respectively, and may be electrically connected to each other through a conductive via (not shown) penetrating through the support member 102. The coil portion 103 may have a spiral shape (not shown), and include lead portions (not shown) formed at the outermost portions of the spiral shape. The lead portions may be exposed to the outside of the body 101 for the purpose of electrical connection to the external electrodes 105 and 106.

Meanwhile, the coil patterns constituting the coil portion 103 may be formed by a plating process used in the related art, such as a pattern plating process, an anisotropic plating process, an isotropic plating process, or the like, and may also be formed as a multilayer structure by a plurality of processes selected from the aforementioned plating processes. A typical example of a material that may be included in the coil portion 130 may include copper (Cu), and various conductive materials may be used as a material of the coil portion 103.

The support member 102 supporting the coil portion 103 may be formed of a polypropylene glycol (PPG) substrate, a ferrite substrate, a metal based soft magnetic substrate, or the like.

The external electrodes 105 and 106 may be formed on outer surfaces of the body 101, and may be connected to the coil portion 103, more specifically, the lead portions of the coil portion 103. The external electrodes 105 and 106 may be formed of a paste including a metal having excellent electrical conductivity, such as a conductive paste including nickel (Ni), copper (Cu), tin (Sn), or silver (Ag), or alloys thereof. In addition, plating layers (not illustrated) may further be formed on the external electrodes 105 and 106. In this case, the plating layers may include one or more materials selected from the group consisting of nickel (Ni), copper (Cu), and tin (Sn). For example, nickel (Ni) layers and tin (Sn) layers may be sequentially formed in the plating layers.

As illustrated in FIG. 3A, the body 101 may have a form in which magnetic particles 112 are dispersed in an insulator or a first insulating material 111. As the insulator or the first insulating material 111, an insulating resin such as an epoxy resin may be used. The magnetic particles 112 may be formed of a conductive material having a magnetic property. An example of such a material may include an Fe-based alloy. In detail, the magnetic particles 112 may be formed of a nanocrystal grain based alloy of having an Fe—Si—B—Nb—Cr composition, an Fe—Ni-based alloy, or the like. When the magnetic particles 112 are implemented using the Fe-based alloy as described above, magnetic characteristics of the body 101, such as a magnetic permeability, and the like, may be excellent, but the body 101 may be vulnerable to electrostatic discharge (ESD), and an appropriate and required insulating insulating structure between the coil portion 103 and the magnetic particles 112 may not be achieved. That is, when insulation properties between the coil portion 103 and the magnetic particles 112 is deteriorated, breakdown voltage characteristics of the coil electronic component may be deteriorated, such that an electrical conduction path between the magnetic particles 112 and the coil portion 103 may be formed to result in dielectric breakdown of the insulation properties, deterioration of characteristics such as a decrease in an inductance of the inductor, or the like.

In the present exemplary embodiment, the ALD layer 104 may be formed, along a surface of the coil portion 103, of an insulating material such as a high-k dielectric material to provide an effective insulating structure of the coil portion 103. In detail, the ALD layer 104 may have a multilayer structure, and may include a first ALD layer 104*a* formed, along the surface of the coil portion 103, using a first insulating material and a second ALD layer 104*b* formed along a surface of the first ALD layer 104*a* using a second insulating material. The first insulating material may be the same as or different from the second insulating material.

As illustrated in FIG. 4, ALD may be a process capable of forming very uniform coating on a surface of a target object P at a level of atomic layers A1 and A2 by a surface chemical reaction in a process of periodically supplying and discharging a reactant, and the ALD layer 104 obtained by the ALD process may have a small thickness and an excellent insulation property. In addition, the ALD layer 104 may have excellent thickness uniformity, and may be improved in terms of heat resistance and thermal expansion characteristics as compared to an insulating layer according to the related art. In this case, the ALD layer 104 may be formed of ceramic such as aluminum oxide or alumina ($Al_2O_3$), silicon oxide or silica ($SiO_2$), or the like.

ALD is a chemical vapor deposition technique for manufacturing inorganic material layers by conformally forming a material layer of high quality because of surface control by, for example, heat treatment to stabilize the deposition surface of a solid. Also, ALD is a film deposition technique based on self-terminating gas-solid reactions, i.e. gas reactants react with the solid surface to form an ALD layer. ALD generally uses halide reactants due to their high reactivity for forming insulating layers of e.g. oxides. During a reaction of a gaseous compound reactant with the solid surface, atoms that are not included in the final film may be removed as gaseous reaction by-products. Irreversible chemisorption forms high quality conformal layers in this process as the solid surface only accepts one layer, i.e. a monolayer. Also, reactant gas pressure does not affect chemisorption in the ALD process as $$\lim_{K\to\infty}\left(Q=\frac{k_a p}{k_a p+k_d}=\frac{1}{1+\frac{1}{Kp}}\right)=1 \qquad \text{Eq. 1}$$

where Q is the equilibrium chemisorption area coverage, p is the reactant gas pressure, ka is adsorption rate constant, and kb is desorption rate constant. During monolayer formation in ALD, ka is much greater than kb as the process is irreversible chemisorption and limiting this situation as K=ka/kb when ka>>kb, the equilibrium coverage Q in Eq. 1 approaches unity, i.e. ALD layer formation becomes independent of reactant gas pressure. Thus, this further enhances the quality of the ALD layer.

In the related art, an insulating layer 104' (FIG. 3B), instead of the ALD layer 104, is generally formed on the surface of the coil portion 103 in a vapor deposition manner such as physical vapor deposition PVD including chemical vapor deposition (CVD), pulsed laser deposition (PLD), radio frequency (rf) or direct current (dc) sputtering, or any other thin film deposition method. In some embodiments, a perylene coating layer is formed at a thickness of several ten micrometers in order to secure a stable coating property.

On the other hand, when a thin film ALD layer 104 is used in the present exemplary embodiment, the magnetic particles 112 may additionally fill in a gap between adjacent coil patterns in the coil portion 103, as illustrated in FIG. 3. Therefore, a total amount of the magnetic particles 112 in the body 101 may be increased, such that an inductance, DC bias characteristics, and the like, of the inductor may be improved. As described above, the ALD layer 104 may be formed to have a relatively small thickness, such that the amount of the magnetic particles 112 in the body 101 may be sufficiently secured. In detail, a thickness t1 (FIG. 3A) of the first ALD layer 104*a* may be about 0.5 μm or less, more preferably, 100 nm or less. Likewise, a thickness t2 (FIG. 3A) of the second ALD layer 104*b* may be about 0.5 μm or less, more preferably, 100 nm or less. In this case, the first and second ALD layers 104*a* and 104*b* may have the same thickness. However, the first and second ALD layers 104*a* and 104*b* may be formed to have different thicknesses, if necessary.

As described above, in the present exemplary embodiment, magnetic characteristics of the coil electronic component as well as insulation properties between the body and the coil patterns may be improved using the ALD layer 104 having the multilayer structure, and materials of the first and second ALD layers 104*a* and 104*b* included in the ALD layer 104 may be selected in consideration of other characteristics. The first and second ALD layers 104*a* and 104*b* may be formed of the same material such as $Al_2O_3$, $SiO_2$, or the like.

Alternatively, the first and second ALD layers 104*a* and 104*b* may be formed of different materials, and materials of the first and second ALD layers 104*a* and 104*b* may be selected so that mismatch between coefficients of thermal expansion (CTEs) of the ALD layer 104 and the coil portion 103 is significantly decreased. In detail, a material of the coil portion 103, such as copper (Cu) may have a CTE of about $18\times10^{-6}$/K, which may be greater than that of a material of the first ALD layer 104*a*. In addition, the material of the first ALD layer 104*a* may have a CTE greater than that of a material of the second ALD layer 104*b*. For example, the first ALD layer 104*a* may include $Al_2O_3$, and the second ALD layer 104*b* may include $SiO_2$. Here, since a CTE of $Al_2O_3$ is about $8\times10^{-6}$/K and a CTE of $SiO_2$ is about $1\times10^{-6}$/K, the first ALD layer 104*a* may serve as a buffer between the coil portion 103 and the second ALD layer 104*b* to decrease the mismatch between the CTE of the coil portion 103 and the second ALD layer 104*b*.

Figure 5:
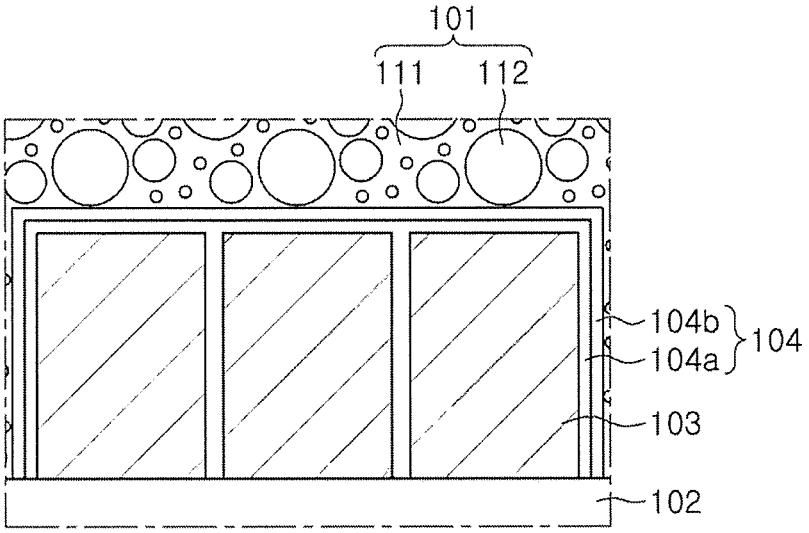
FIG. 5 is a schematic cross-sectional view illustrating a coil electronic component according to a modified embodiment.

Meanwhile, in FIG. 5, a gap secured by using the ALD layer 104 is not filled with the magnetic particles 112, but may also be used to increase an area of the coil portion 103. Referring to a modified embodiment of FIG. 5, only a first ALD layer 104*a* of the ALD layer 104 may be formed between adjacent coil patterns in the coil portion 103. In addition, a second ALD layer 104*b* may be provided to cover a surface of the first ALD layer 104*a*. As described above, the coil portion 103 may have an extending area, such that DC resistance (Rdc) characteristics may be improved.

In addition, only a structure in which the ALD layer 104 includes two layers is described in the abovementioned exemplary embodiments, but the ALD layer 104 may also include three or more layers, if necessary.

As set forth above, in the coil electronic component according to the exemplary embodiment in the present disclosure, an electrical insulation property between the body and the coil patterns may be improved, such that electrical and magnetic characteristics of the coil electronic component may be improved.

While exemplary embodiments have been shown and described above, it will be apparent to those skilled in the art that modifications and variations could be made without departing from the scope of the present invention as defined by the appended claims.

What is claimed is:

1. A coil electronic component comprising:

a body comprising:

magnetic particles dispersed in a first insulating material, a coil portion embedded in the first insulating material;

a first insulating layer along a surface of the coil portion and formed of a second insulating material;

a second insulating layer along a surface of the first insulating layer and formed of a third insulating material; and external electrodes connected to the coil portion, wherein a material of the coil portion has a coefficient of thermal expansion (CTE) greater than that of a material of the first insulating layer, and the material of the first insulating layer has a CTE greater than that of a material of the second insulating layer.

2. The coil electronic component of claim 1, wherein the first insulating layer has a thickness of 0.5 μm or less.

3. The coil electronic component of claim 1, wherein the second insulating layer has a thickness of 0.5 μm or less.

4. The coil electronic component of claim 1, wherein the first and second insulating layers are formed of the same material.

5. The coil electronic component of claim 1, wherein the first and second insulating layers are formed of different materials.

6. The coil electronic component of claim 1, wherein the first insulating layer includes $Al_2O_3$, and the second insulating layer includes $SiO_2$.

7. The coil electronic component of claim 6, wherein the coil portion includes Cu.

8. The coil electronic component of claim 1, wherein the magnetic particles fill in a gap between adjacent coil patterns in the coil portion.

9. The coil electronic component of claim 1, wherein only the first insulating layer is formed in a gap between adjacent coil patterns in the coil portion.

10. The coil electronic component of claim 1, wherein the magnetic particles have conductivity.

11. The coil electronic component of claim 10, wherein the magnetic particles include an Fe-based alloy.

12. The coil electronic component of claim 1, wherein the first insulating material is an insulating resin.

13. The coil electronic component of claim 9, wherein the first insulating layer covers the coil portion.

14. The coil electronic component of claim 1, wherein each of the first and second insulating layers includes an atomic layer deposition layer.

* * * * *